US006330417B1

(12) United States Patent
Behe et al.

(10) Patent No.: US 6,330,417 B1
(45) Date of Patent: Dec. 11, 2001

(54) ALUMINIZED ROLL INCLUDING ANODIZATION LAYER

(75) Inventors: Thomas J. Behe, Webster; Jeffrey J. Folkins, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/553,633

(22) Filed: Apr. 20, 2000

(51) Int. Cl.[7] ..... G03G 15/08
(52) U.S. Cl. ..... 399/286; 492/48
(58) Field of Search ..... 399/286, 276, 399/279, 283, 266, 176; 492/37, 48, 49, 53, 54, 57, 58; 205/116; 427/560; 428/472, 457

(56) References Cited

U.S. PATENT DOCUMENTS

| | | | | |
|---|---|---|---|---|
| Re. 35,698 | | 12/1997 | Behe et al. | 399/286 |
| 3,950,089 | | 4/1976 | Fraser et al. | 355/3 DD |
| 4,034,709 | | 7/1977 | Fraser et al. | 118/658 |
| 4,189,815 | * | 2/1980 | Seelenbinder | 492/37 X |
| 4,288,469 | * | 9/1981 | Meyer et al. | 427/560 |
| 4,715,901 | * | 12/1987 | Granger | 428/472.2 |
| 4,737,246 | * | 4/1988 | Powers et al. | 205/116 |
| 4,774,541 | | 9/1988 | Martin et al. | 355/3 DD |
| 4,868,600 | | 9/1989 | Hays et al. | 355/259 |
| 4,893,151 | | 1/1990 | Yamazaki et al. | 355/245 |
| 4,984,019 | | 1/1991 | Folkins | 355/215 |
| 5,010,367 | | 4/1991 | Hays | 355/247 |
| 5,032,872 | | 7/1991 | Folkins et al. | 355/259 |
| 5,043,768 | | 8/1991 | Baruch | 355/284 |
| 5,063,875 | | 11/1991 | Folkins et al. | 118/651 |
| 5,128,723 | | 7/1992 | Bolte et al. | 355/259 |
| 5,245,392 | | 9/1993 | Behe et al. | 355/259 |
| 5,322,970 | | 6/1994 | Behe et al. | 118/651 |
| 5,338,893 | * | 8/1994 | Edmunds et al. | 399/266 |
| 5,341,197 | | 8/1994 | Folkins et al. | 355/264 |
| 5,384,627 | | 1/1995 | Behe et al. | 355/247 |
| 5,420,375 | | 5/1995 | Folkins et al. | 118/652 |
| 5,473,418 | | 12/1995 | Kazakos et al. | 355/259 |
| 5,570,164 | * | 10/1996 | Yamamoto et al. | 399/283 |
| 5,600,414 | * | 2/1997 | Hyllberg | 399/176 |
| 5,659,862 | * | 8/1997 | Mahmud et al. | 399/276 |
| 5,701,572 | | 12/1997 | Behe et al. | 399/354 |
| 5,761,598 | | 6/1998 | Kazakos et al. | 399/349 |
| 6,212,349 | * | 4/2001 | Labombard | 399/286 |

* cited by examiner

*Primary Examiner*—Sophia S. Chen
*Assistant Examiner*—Hoan Tran
(74) *Attorney, Agent, or Firm*—Andrew D. Ryan

(57) ABSTRACT

An aluminum roll for use in an apparatus in which making particles are advanced toward a latent image to form a developed image. The roll is formed by diamond turning prior to forming an anodization layer and prior to applying a sealant.

39 Claims, 3 Drawing Sheets

ALUMINIZED ROLL INCLUDING ANODIZATION LAYER

FIELD OF THE INVENTION

This invention relates to a printing apparatus and, more particularly, to a printer including a roll having an aluminum core with a mirror-like finish on the exterior surface prior to an anodization layer being formed on the exterior surface, and a sealant associated with the anodization layer, and a method of making the same.

BACKGROUND OF THE INVENTION

Reference is made to copending application, Ser. No. 09/553,369 entitled, Method of Making an Aluminized Roll, filed currently herewith, and the disclosure of which is totally incorporated herein by reference.

Electrophotographic marking is a well-known, commonly used method of copying or printing documents. Electrophotographic marking is performed by exposing a charged photoreceptor with a light image representation of a desired document. The photoreceptor is discharged in response to that light image, creating an electrostatic latent image of the desired document on the photoreceptor's surface. Toner particles are then deposited onto the latent image, forming a toner image, and then transferred onto a substrate, such as a sheet of paper. The transferred toner image is then fused to the substrate, usually using heat and/or pressure, thereby creating a permanent record of the original representation. The surface of the photoreceptor is then cleaned of residual developing material and recharged in preparation for the production of other images. Other marking technologies, for example, electrostatographic marking and ionography are also well-known.

Many electrostatographic marking machines include a developer having a developer housing, a transport roll, a donor roll, and an electrode structure. In such a developer, the transport roll advances carrier and toner to a loading zone adjacent the donor roll. The transport roll is electrically biased relative to the donor roll such that toner is attracted from the carrier to the donor roll. The donor roll then advances toner from the loading zone to a development zone adjacent the photoreceptor. In general, a donor roll includes a conductive core and a partially conductive surface. In hybrid scavengeless development, the donor roll provides an electrostatic "intermediate" between the photoreceptor and the transport roll.

While existing rolls are generally suitable, improvements in development quality and performance are desired. However, previous attempts to improve quality and performance have included additional machining and grinding of the outer periphery of the core of the roll. These additional steps increase the cost of the rolls. Therefore, an improved cost-effectiveroll providing excellent electrical properties, cost effectiveness, smaller pinholes and inclusions, high conductivity/time constant, and tolerances would be beneficial.

Reference is made to the following United States patents relating, for example, to reproduction machines, development apparatus, and components.

U.S. Pat. No. 3,950,089 relates to a development apparatus in which a surface for the direct conveyance of electrically-conductive toner comprises a dielectric sheath.

U.S. Pat. No. 4,034,709 relates to a development apparatus in which a surface for the direct conveyance of toner comprises styrenebutadiene.

U.S. Pat. No. 4,774,541 relates to discloses a development apparatus in which a surface for the direct conveyance of toner is doped with carbon black.

U.S. Pat. No. 4,868,600 relates to a scavengeless development system in which toner detachment from a donor and the concomitant generation of a controlled powder cloud is obtained by AC electric fields supplied by self-spaced electrode structures.

U.S. Pat. No. 4,893,151 relates to a single component image developing apparatus including a developing roller coated with a chemical vapor deposition ceramic and an elastic blade coated with a ceramic.

U.S. Pat. No. 4,984,019 relates to an apparatus in which contaminants are removed from an electrode positioned between a donor roller and a photoconductive surface.

U.S. Pat. No. 5,010,367 relates to a scavengeless/non-interactive development system for use in highlight color imaging.

U.S. Pat. No. 5,032,872 relates to an apparatus for developing a latent image recorded on a photoconductive member in an electrophotographic printing machine.

U.S. Pat. No. 5,043,768 relates to a rotating release liquid applying device for a fuser including an outer porous ceramic material.

U.S. Pat. No. 5,063,875 relates to an apparatus which develops an electrostatic latent image. A transport roll advances developer material from a chamber to a donor roll.

U.S. Pat. No. 5,128,723 relates to an apparatus which develops an electrostatic latent image recorded on a photoconductive member with toner.

U.S. Pat. No. 5,245,392 and RE 35698 relate to a phenolic resin coated on a donor roll.

U.S. Pat. No. 5,322,970 relates to a donor roll for the conveyance of toner in a development system for an electrophotographic printer includes an outer surface of ceramic.

U.S. Pat. No. 5,341,197 relates to a method and apparatus involving the stopping and starting of the development of images, using hybrid development, to insure proper charging of the donor toner layer.

U.S. Pat. No. 5,384,627 relates to a developer unit adapted to develop a latent image with toner particles.

U.S. Pat. No. 5,420,375 relates to a method and apparatus involving the stopping and starting of the development of images, using hybrid development, to insure proper charging of the donor toner layer.

All documents cited herein, including the foregoing, are incorporated herein by reference in their entireties.

SUMMARY OF THE INVENTION

The principles of the present invention provide for a roll with a core comprised of aluminum and method thereof. The core comprises an outer surface that is prepared to a substantially mirror-like finish prior to anodization. The mirror-like finish may be formed using an industrial grade diamond and a lathe turning operation. Alternatively, the mirror-like finish may be formed by polishing. An anodization layer having a thickness ranging from about 1 to 100 microns is then formed on the mirror-like outer surface and on the ends of the roll. A sealant is then applied on the anodization layer such that it substantially seals the roll. The sealant may include nickel acetate, hot water, polytetrafluorethylene (PTFE), NITUFF™, sodium dichromate, equivalent sealants, and combinations thereof. The sealant, NITUFF™, is presently commercially available from Nimet Industries, Inc. of South Bend Indiana.

The aluminum material for the core of the roll is commercially available in a variety of grades from, for example, VAW of America, St. Augustine, Fla. and from Alcoa. The Aluminum Association, Inc. (AAI) promulgates the American National Standard (ANSI) alloy designation systems for aluminum wrought and cast alloys and for other aluminum products. AAI registers chemical composition limits of alloys, assigns alloy designations and publishes registration records. Other designation systems than AAI are envisioned which correlate to grades of generally high purity aluminum alloy, and the other designation systems and corresponding grades are interchangeable as a core material. For example, equivalent aluminum alloy grading systems and compositions having other aluminum alloy grades of a generally higher purity are interchangeable as a base material for the core. The chemical composition of the aluminum alloy may be tested using the ASTM method E34 Spectrochemical Analysis.

This invention relates generally to a roll with a core made of high purity aluminum such as from about 90% to about 100% pure aluminum. The core exterior surface may be prepared using a diamond turning operation prior to formation of an anodization layer thereon. A sealant may be applied over the anodization layer or be associated with the anodization layer via an anodization bath process. Various grades of generally high purity aluminum, mirror-like finish processes, anodization processes, and sealants are envisioned.

One aspect of the invention relates to a roll comprising a cylindrical member comprising aluminum. The cylindrical member has a length, a diameter, an outside surface, and ends. An anodization layer is formed on at least a portion of the cylindrical member. A sealant is associated with at least a portion of the anodization layer. Prior to formation of the anodization layer, a roughness average of the outside surface of the cylindrical member ranges between about 0.5 microinches to about 4 microinches. The roll may be masked at desired areas along the outside surface and ends to prevent anodization or sealing of portions of the cylindrical member or the associated journals.

Another aspect of the invention relates to a printing apparatus having a substantially cylindrical roll in which the roll has a first outer surface, and ends. The substantially cylindrical roll comprises an aluminum alloy composition including at least about 95% aluminum, such as about 96% to about 99.9% aluminum. An anodization layer having a thickness ranging from about 1 to 100 microns, and a second outer surface is formed on the first outer surface of the substantially cylindrical roll. A sealant is associated with at least a portion of the anodization layer. The first outer surface has a first roughness average prior to the formation of the anodization layer that is less than the second roughness average of the second outer surface, for example, the first roughness average may be about 75% to about 99% less than the second roughness average.

Another aspect of the invention relates to an apparatus having a cylindrical member including a conductive aluminum material having a purity ranging from about 95% to about 99.9% pure aluminum. The cylindrical member includes a length and an outer periphery surface having a mirror-like finish. The outer periphery surface is formed at least partially by a diamond turning operation. An anodization layer having a thickness is formed on the mirror-like outer periphery surface. The anodization layer includes pinholes, inclusions, and peaks and valleys. A sealant is formed on at least a portion of the anodization layer. The sealant seals the pinholes, inclusions, and peaks and valleys of the anodization layer.

Another aspect of the invention relates to a method of making a roll comprising: forming a substantially cylindrical member comprising aluminum using at least one of a diamond turning operation and a polishing operation, the outside surface of the substantially cylindrical member has an average surface finish ranging from about 0.5 to about 4 microinches prior to anodization; forming an anodization layer on the outer surface of the member; and sealing at least a portion of the anodization layer with a sealant.

Another aspect of the invention relates to a method of preparing a printing apparatus component comprising: forming a substantially cylindrical roll having a first outer surface, and ends, the substantially cylindrical roll comprising an aluminum alloy composition including at least about 95% aluminum; forming an anodization layer on the first outer surface of the substantially cylindrical roll, the anodization layer having a thickness ranging from about 1 to 100 microns and a second outer surface; and sealing at least a portion of the anodization layer with a sealant. The first outer surface has a first roughness average prior to the formation of the anodization layer that is less than the second roughness average of the second outer surface.

Another aspect of the invention relates to a roll for use in a printing apparatus made by the process comprising: providing a member comprising aluminum, the member including a length, a proximal end, a distal end, and an outer surface; forming an outer surface on the member using a diamond turning operation; forming an anodization layer on the outer surface of the member, the anodization layer having a thickness ranging from about 1 to 100 microns, the anodization layer having pinholes with an average diameters of less than about 20 microns and inclusions with an average depth of less than about 20 microns; and sealing the anodization layer, the sealant comprising at least one of nickel acetate, sodium dichromate, hot water, and polytetrafluoroethylene.

Still other aspects and advantages of the present invention and methods of construction of the same will become readily apparent to those skilled in the art from the following detailed description, wherein embodiments are shown and described, simply by way of illustration. As will be realized, the invention is capable of other and different embodiments and methods of construction, and its several details are capable of modification and interchangeability in various obvious respects, all without departing from the invention. Accordingly, the drawing and description are to be regarded as illustrative in nature, and not as restrictive.

DETAILED DESCRIPTION OF THE INVENTION

While the principles and embodiments of the present invention will be described in connection with an electrostatographic reproduction apparatus, it should be understood that the present invention is not limited to that embodiment or to that application. Therefore, it should be understood that the principles of the present invention and embodiments extend to all alternatives, modifications, and equivalents thereof.

Figure 1:
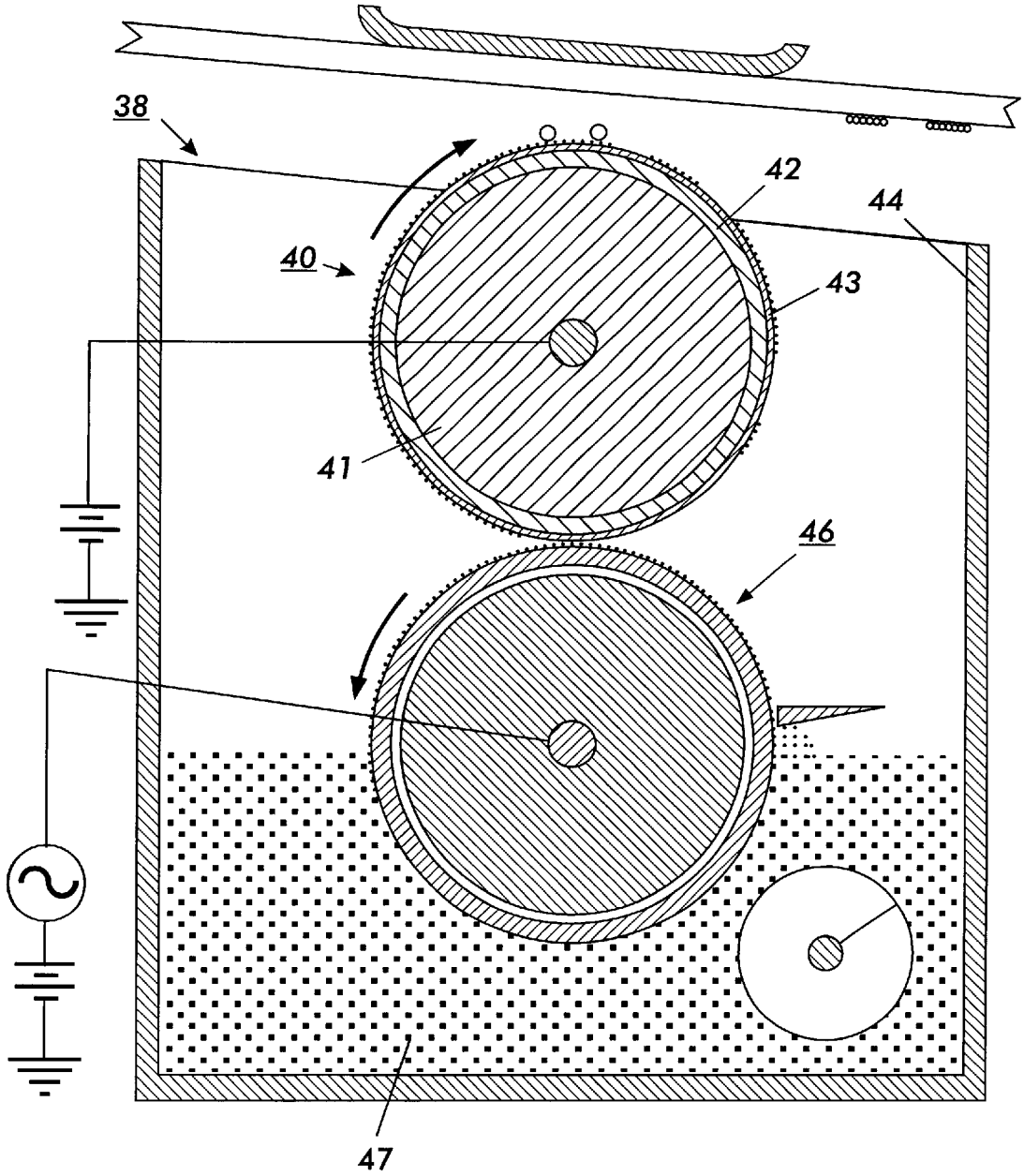
FIG. 1 is an elevation view of a developer unit using two component developer material incorporating the features of the donor roll of the present invention therein.

Turning to FIG. 1, a developer 38 is illustrated including a donor roll 40 mounted, at least partially, in the chamber of developer housing 44. The chamber stores a supply of developer material 47. A transport roll 46 disposed in the chamber conveys the developer material to the donor roll 40. The transport roll 46 is electrically biased relative to the donor roll 40 so that the toner particles are attracted from the transport roll 46 to the donor roll 40. The donor roll 40 includes a core 41 incorporating a generally high purity aluminum alloy that has been machined using an industrial grade diamond to obtain a mirror-like quality surface having a tightly controlled total indicated runout.

Figure 2:
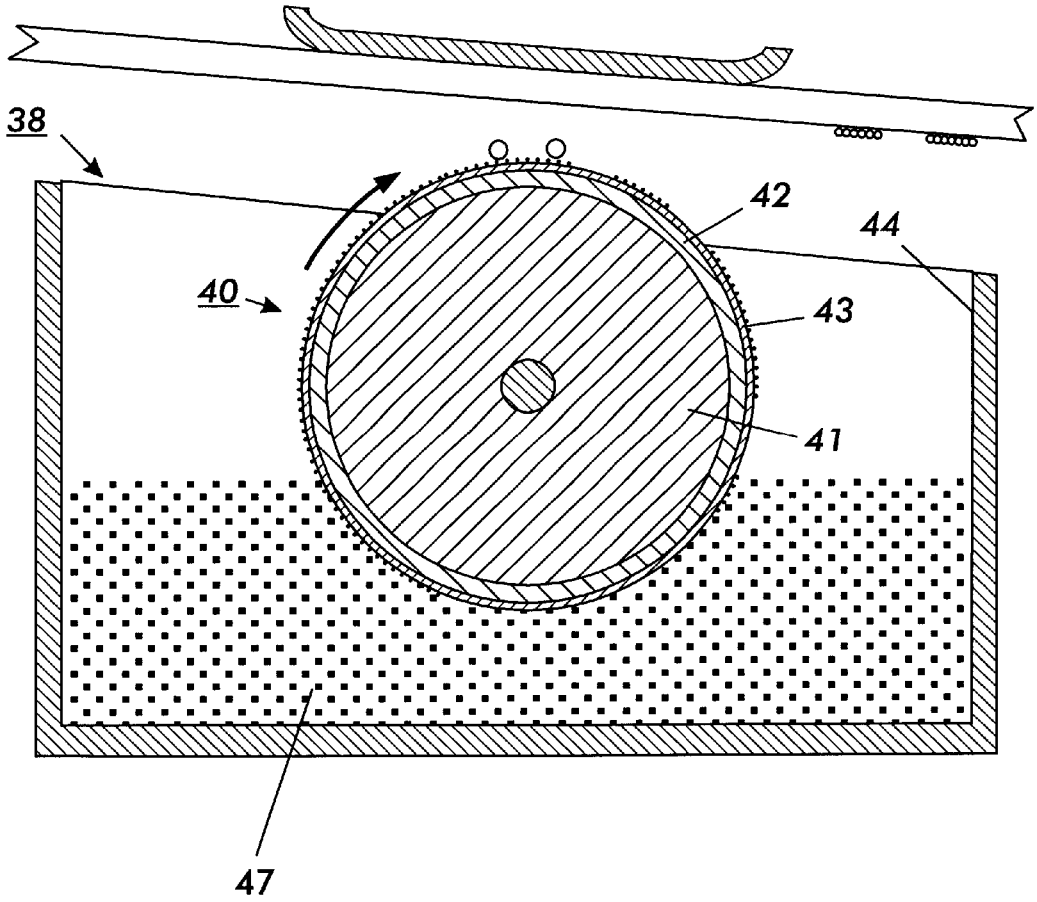
FIG. 2 is an elevation view of a developer unit using single component developer material incorporating the features of the donor roll of the present invention therein.

FIG. 2 illustrates a developer 38 incorporating roll 40 and a chamber in a developer housing 44 for storing a supply of developer material 47 such as in a single-component scavengeless development system. The roll 40 includes a core 41 with a diameter, a length, and ends. An anodization layer 42 having a thickness is formed on an exterior surface and the ends of the core 41. A sealant 43 is formed with the anodization layer 42.

Figure 3:
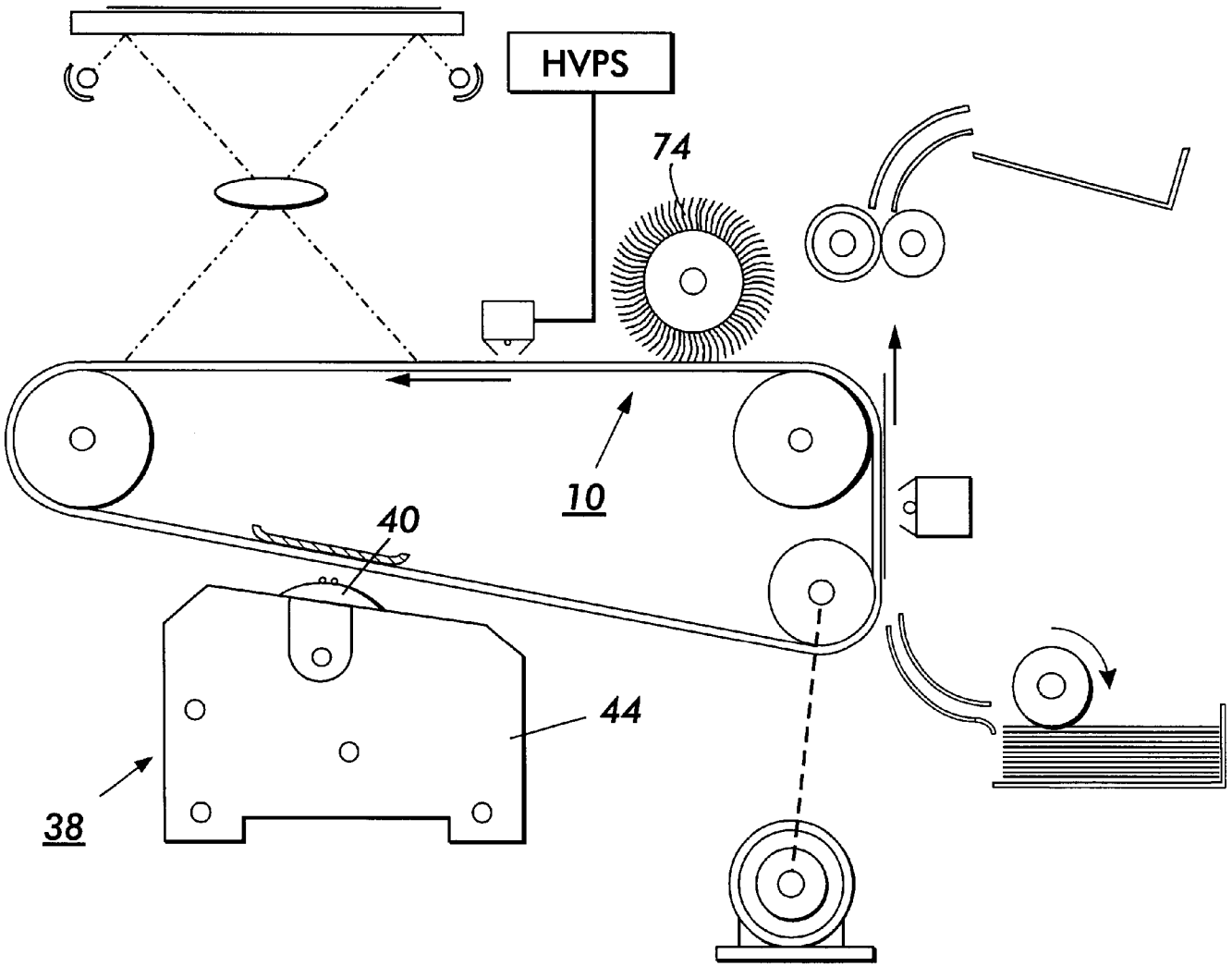
FIG. 3 is an elevation view of an illustrative printing machine in which the present invention may be used.

FIG. 3 illustrates an electrostatographic printing apparatus incorporating developer 38. The roll 40 picks up toner to convey to the photoreceptor 10 directly from a supply of toner in the housing 44. Reference to a printing apparatus is made in U.S. Pat. No. 5,322,970. The roll 40 may be incorporated in an analog printer, digital printer, analog copier, or digital copier.

In use, the roll 40 typically has a length of about 12 inches to about 14 inches and a diameter of about ¾ inch to about 1½ inches. A roll 40 having a length ranging from about 8 inches to about 50 inches and a diameter to ranging from about 0.25 inches to about 3 inches is envisioned. The core 41 may be made of a one-piece or multi-piece construction made from an extrusion or from a cast piece. The core 41 comprises a generally high purity aluminum alloy, for example, an alloy composition greater than about 95% pure aluminum. The aluminum is beneficially alloyed with one or more elements, for example, copper, manganese, silicon, magnesium or zinc to primarily enhance desired characteristics such as increased strength, corrosion resistance and weldability.

Various grades of high purity aluminum alloy may be selected for the core 41. For example, grade 1100, grade 1135, grade 6000 family, grade 6061, a grade having a higher purity than a grade 6061, grades 6061-T4 through 6061-T10, grade 6063, grades 6063-T3 through 6063-T10, grade 6163, grade 6463, or grades 6463-T4 through 6463-T10 may be used.

The roll 40 may be selected as, for example, a donor roll, a xerographic detoning roll, a cleaning subsystem, and a backer bar roll. The core 41 is beneficially made by precision machining the surfaces and by providing low tolerances relating to diameter, runout, and surface finish. Minimization of eccentricity of the core 41 and the total indicated runout is generally desired. The core 41 may have a total indicated runout of about 1 micron to about 40 microns. The total indicated runout refers to the sum of: a runout measurement between the outer periphery and the counterbore inside diameter; the roundness measurement of the core; and the roundness measurement of the journals.

The anodization layer 42 has a thickness ranging from about 1 micron to about 100 microns; preferably, from about 25 to about 75 microns, and especially preferred, from about 40 microns to about 60 microns. The anodization layer 42 is formed by a anodization process. The anodization process may include placing the entire roll in a bath of low temperature sulfuric acid and allowing an anodization layer 42 to grow to a desired uniform thickness on all of the exposed surfaces, substantially simultaneously. For example, the bath may be 15% by weight sulfuric acid and the temperature of the bath may range from about 32 degrees Fahrenheit to about 35 degrees Fahrenheit. Anodization is a growth process of aluminum oxide on the aluminum substrate. The base aluminum sacrifices an aluminum oxide molecule in a bath when electric current is applied and pinholes are formed at boundaries. Water affects the conductivity and charge relaxation time constant of the donor surface. Depending on the ambient relative humidity conditions, the level of water present within the porous surface formed may vary. The surface sealant conductivity and time constant can impact the development process, for example, charge ghosting, and reload efficiency. A generally constant conductivity/time constant and hence constant water level is desirable. The outside surface of the roll 40 may have a discharge time constant between about 1 microsecond and about 2 milliseconds and a conductivity between about $4\times10^{-10}(\Omega\text{-cm})^{-1}$ and about $8\times10^{-7}(\Omega\text{-cm})^{-1}$. The anodization layer 42 may have some pinholes with average diameters, for example, up to about 20 microns, and some inclusions with average depths, for example, up to about 20 microns. The anodization layer 42 may have average distances between the peaks and valleys ranging from about 0.5 microns to about 3 microns. The anodization layer 42 may have a thickness ranging from about 40 microns to about 60 microns and can withstand an applied voltage exceeding 400 volts.

The sealant 43 may be disposed on the anodization layer 42 to seal and fill the valleys, pinholes, inclusions and entire anodization layer. The sealant 43 is generally effective in reducing print quality defects due to humidity swings. Providing an anodization layer 42 and sealant 43 on the ends of the roll 40 generally reduces instances of shorting of a donor roll 40 to a developer roll. Use of a sealant 43 with the anodization layer 42 generally reduces performance problems when lab humidity drops below 40% relative humidity. The sealant 43 may be applied to the anodization layer 42 in a secondary bath process or coating process. Alternatively, the sealant 43 may be applied during the anodization bath process. The hot water sealant may be applied using a secondary bath process or a steam process. The sealant 43 associated with the anodization layer 42 has a thickness ranging from about 1 to about 100 microns.

The core 41, prior to formation of the anodization layer therewith, has a roughness average (RA) on the outside surface of the cylindrical member ranging between about 0.5 microinches to about 4 microinches. After formation of the anodization layer 42, the roughness average of the outside surface of the anodization layer ranges between about 16 microinches to about 24 microinches. Moreover, subsequent to formation of the anodization layer 42 and association of the sealant 43 therewith, the roughness average of the outside surface of the sealant ranges between about 16 microinches to about 45 microinches.

The roll 40 reduces product quality defects relating to print quality as it has a total indicated runout of about 0.0015 inches or less by diamond turning of the surface prior to anodization. In addition, use of generally high purity aluminum alloy in the core 41 substantially reduces formation of pinholes and inclusions on or in the anodization layer 42. Furthermore, the anodization layer 42 grows substantially uniformly on the core 41 and variations of thickness on the core 41 of less than 0.0005 inches can generally be achieved on the core 41. The roll 40 has improved composition, precision tolerances, surface finish, consistent roll thickness, and the thickness uniformity of the anodization layer.

While this invention has been described in conjunction with various embodiments, it is evident that many alternatives, modifications, and variations thereof will be apparent to those skilled in the art. Accordingly, it is intended to embrace all such alternatives, modifications, and variations and their equivalents.

What is claimed is:

1. A roll comprising:

a cylindrical member comprising aluminum, the cylindrical member having a length, a diameter, an outside surface, and ends;

an anodization layer formed on at least a portion of the cylindrical member; and a sealant associated with at least a portion of the anodization layer;

wherein prior to formation of the anodization layer, a mirror-like finish having a roughness average of the outside surface of the cylindrical member ranges between about 0.5 microinches to less than 3.937 microinches.

2. The roll of claim 1 further comprising a developer system for use with the roll and wherein prior to formation of the anodization layer, the roughness average of the outside surface of the cylindrical member ranges between about 0.5 microinches to about 2 microinches.

3. The roll of claim 2 wherein the outside surface of the cylindrical member has a roughness average ranging from about 0.5 to about 1.3 microinches.

4. The roll of claim 1 wherein after formation of the anodization layer, the roughness average of the outside surface of the anodization layer ranges between about 16 microinches to about 24 microinches.

5. The roll of claim 1 wherein after formation of the anodization layer and association of the sealant, the roughness average of the outside surface of the sealant ranges between about 16 microinches to about 45 microinches.

6. The roll of claim 1 wherein the aluminum is a substantially high purity aluminum and an aluminum alloy.

7. The roll of claim 6 wherein the aluminum alloy includes at least about 95% pure aluminum.

8. The roll of claim 6 wherein the cylindrical member comprises an alloy selected from at least one of a grade 6000 family, grade 1100, and grade 1135.

9. The roll of claim 1 wherein the aluminum alloy includes about 95% to about 100% pure aluminum.

10. The roll of claim 1 wherein the aluminum comprises at least one of grade 6061, grade 6163, and grade 6463.

11. The roll of claim 1 wherein the aluminum comprises at least one of grade 6061-T4, grade 6063-T6, and grade 6463-T6.

12. The roll of claim 1 wherein the aluminum is selected from a grade of aluminum having a higher purity than a grade 6061.

13. The roll of claim 1 wherein the anodization layer is formed with pinholes, inclusions, peaks, and valleys.

14. The roll of claim 13 wherein the pinholes have average diameters of less than about 20 microns, the inclusions have average depths of less than about 20 microns; and the average distance between the peaks and valleys ranges from about 0.5 microns to about 3 microns.

15. The roll of claim 13 wherein the sealant substantially seals at least one of the pinholes, inclusions, peaks, and valleys.

16. The roll of claim 15 wherein the sealant substantially fills at least one valley.

17. The roll of claim 1 wherein the sealant comprises at least one of nickel acetate, sodium dichromate, polytetrafluorethylene, and mixtures thereof.

18. The roll of claim 1 wherein the sealant comprises hot water.

19. The roll of claim 1 wherein the sealant has a thickness ranging from about 1 to about 100 microns.

20. The roll of claim 1 wherein the sealant substantially seals the anodization layer.

21. The roll of claim 1 wherein the anodization layer has a thickness ranging from about 1 micron to about 100 microns.

22. The roll of claim 1 wherein the anodization layer has a thickness ranging from about 25 microns to about 75 microns.

23. The roll of claim 1 wherein a thickness of the anodization layer varies less than about 0.0005 inches over the length of the cylindrical member.

24. A roll comprising:

a cylindrical member comprising aluminum, the cylindrical member having a length, a diameter, an outside surface, and ends;

an anodization layer formed on at least a portion of the cylindrical member; and a sealant associated with at least a portion of the anodization layer;

wherein the outside surface of the cylindrical member is a diamond machined surface and wherein prior to formation of the anodization layer, a roughness average of the outside surface of the cylindrical member ranges between about 0.5 microinches to about 4 microinches.

25. A roll comprising:

a cylindrical member comprising aluminum, the cylindrical member having a length, a diameter, an outside surface, and ends;

an anodization layer formed on at least a portion of the cylindrical member; and a sealant associated with at least a portion of the anodization layer;

wherein prior to formation of the anodization layer, a roughness average of the outside surface of the cylindrical member ranges between about 0.5 microinches to about 4 microinches and wherein the roll has an average total indicated runout of less than about 0.0015 inches.

26. A printing apparatus comprising:

a substantially cylindrical roll having a first outer surface, and ends, the substantially cylindrical roll comprising an aluminum alloy composition including at least about 95% aluminum;

an anodization layer formed on the first outer surface of the substantially cylindrical roll, the anodization layer having a thickness ranging from about 1 to 100 microns and a second outer surface; and a sealant associated with at least a portion of the anodization layer;

wherein the first outer surface has a first roughness average prior to the formation of the anodization layer that is less than the second roughness average of the second outer surface.

27. The printing apparatus of claim 26 wherein the first roughness average is less than about 50% of the second roughness average.

28. The printing apparatus of claim 26 wherein the first roughness average ranges from about 0.5 microns to about 4 microns and the second roughness average ranges from about 16 microns to about 24 microns.

29. The printing apparatus of claim 26 wherein the sealant comprises at least one of nickel acetate, sodium dichromate, and polytetrafluorethylene, the sealant having a thickness ranging from about 1 to 100 microns.

30. The printing apparatus of claim 26 wherein prior to formation of the anodization layer, the first outer surface has a mirror-like finish.

31. The printing apparatus of claim 26 wherein the first outer surface is a diamond turned surface.

32. The printing apparatus of claim 26 wherein the anodization layer is formed on the ends.

33. The printing apparatus of claim 26 wherein the printing apparatus is at least one of an analog printer, digital printer, analog copier, and digital copier.

34. An apparatus comprising:

a cylindrical member comprising a conductive aluminum material having a purity ranging from about 95% to about 99.9% pure aluminum, the cylindrical member including a length and an outer periphery surface, the outer periphery surface formed at least partially by a diamond turning operation;

an anodization layer formed on the outer periphery surface, the anodization layer having a thickness, the anodization layer including pinholes, inclusions, and peaks and valleys; and a sealant formed on at least a portion of the anodization layer, the sealant adapted to seal the pinholes, inclusions, and peaks and valleys of the anodization layer.

35. The apparatus of claim 34 wherein the apparatus has a mirror-like finish including a roughness average less than about 2 microinches and the apparatus has an average total indicated runout of less than about 0.0015 inches.

36. The apparatus of claim 34 wherein the apparatus includes an outside surface having a discharge time constant ranging between about 1 microsecond and about 2 milliseconds.

37. The apparatus of claim 34 wherein the apparatus including an outside surface having a conductivity ranging between about $4\times10^{-10}(\Omega\text{-cm})^{-1}$ and about $8\times10^{-7}(\Omega\text{-cm})^{-1}$.

38. The apparatus of claim 34 wherein the cylindrical member is a donor roll mounted at least partially in the chamber of a housing, the donor roll adapted to advance toner particles to a latent image.

39. The apparatus of claim 34 wherein the anodization layer has a thickness ranging from about 40 microns to about 60 microns and can withstand an applied voltage exceeding 400 volts.

* * * * *